United States Patent [19]

Fogelgren

[11] Patent Number: 4,819,814

[45] Date of Patent: Apr. 11, 1989

[54] SNAP-FIT DISPLAY ASSEMBLY

[76] Inventor: John Fogelgren, 647 Binnacle Dr., Naples, Fla. 33940

[21] Appl. No.: 114,597

[22] Filed: Oct. 30, 1987

[51] Int. Cl.[4] ..... A47F 7/00

[52] U.S. Cl. ..... 211/50; 211/55; 211/194; 211/133; 312/107; 312/108

[58] Field of Search ..... 211/50, 194, 40, 189, 211/55, 133; 312/8, 107, 108, 111; 40/124

[56] References Cited

U.S. PATENT DOCUMENTS

| | | | |
|---|---|---|---|
| 2,365,622 | 12/1944 | Brockius | 312/108 X |
| 2,649,968 | 8/1953 | Rice | 211/40 X |
| 3,288,301 | 11/1966 | Kent | 312/108 X |
| 4,290,530 | 9/1981 | Wooster | 211/40 |
| 4,367,000 | 1/1983 | Sparks et al. | 312/107 X |
| 4,577,914 | 3/1986 | Stravitz | 312/107 X |
| 4,643,494 | 2/1987 | Marleau | 312/107 X |

*Primary Examiner*—Reinaldo P. Machado
*Assistant Examiner*—Sarah A. Lechok Eley
*Attorney, Agent, or Firm*—Cushman, Darby & Cushman

[57] ABSTRACT

A display assembly formed from a number of individual display modules which are snap-fit together so as to provide a unitary display assembly. Each of the individual display modules is in turn formed from identical side walls and identical front and rear panels, the side walls being mounted to the front and rear panels in a snap-fitting relation so as to form a unitary structure. Further structures such as base stands and angular brackets can be provided which enhance the versatility of the display assembly as a whole.

18 Claims, 4 Drawing Sheets

10
24
24
12
10
24
12
22
66
16
14
20
14
16
10
54
54
18

SNAP-FIT DISPLAY ASSEMBLY

BACKGROUND OF THE INVENTION

The present invention relates to display assemblies and, more particularly, to a display assembly for, for example, brochures and magazines which includes a plurality of display modules which are snap-fit together so as to form a unitary assembly.

Heretofore literature displays have been molded as integral structures which have a plurality of pockets of one or more sizes into which literature can be placed for display to potential readers and for easy access. Such displays have the disadvantage that because they are molded as an integral unit at the factory, a number of display molds must be provided so that display units of various sizes and having various numbers and sizes of pockets can be provided. Further, since the displays are one piece units, they must be shipped full-size to the customer. Thus, manufacturing and shipping costs are high and the purchaser can only display brochures, magazines, and the like in the manner dictated by the size and configuration of the preformed display unit.

It would therefore be desirable to provide a display assembly in the form of a number of discrete display modules or pockets which can be coupled together to form displays of various sizes and shapes so that fewer, smaller molds can be provided to manufacture the parts of the display assembly. Further, shipping costs could be reduced since the display could be packed more compactly. In addition, by providing discrete display modules, the consumer would be able to vary the manner in which the display is assembled depending upon his needs at a particular time or for decorative purposes.

It would further be desirable to form each of the display modules or pockets themselves from a number of structural elements which can be coupled together so that manufacturing and shipping costs could be further reduced while still enabling easy assembly by the consumer.

SUMMARY OF THE INVENTION

It is an object of the present invention to provide a display assembly which is formed from a plurality of display modules that are snap-fit together vertically and/or horizontally so as to provide a display assembly that can be shipped at reduced cost and assembled by the consumer in accordance with his particular needs or taste.

It is a further object of the present invention to provide display modules for such a display assembly which can themselves be assembled and disassembled simply and easily by the consumer to thereby reduce manufacturing and shipping costs.

These and other objects of the present invention are provided with a display module which includes front and rear walls or panels and first and second side walls, each of the side walls including coupling structures for removably coupling the same to a next adjacent side wall of a next adjacent module and coupling structures for releasably coupling the module to a next adjacent upper module and a next adjacent lower module. In this manner a number of modules can be coupled together horizontally and/or vertically to accommodate a particular customer's needs and to versatilly, decoratively display brochures and/or magazines and yet can be disassembled to reduce shipping costs or reduce storage space. The objects of the present invention are further realized by providing display modules which can themselves be disassembled by forming the side walls so as to be releasably couplable to the front and rear panels of the module.

Other objects, features, and characteristics of the present invention, as well as the methods of operation and functions of the related elements of the structure, and the combination of parts and economies of manufacture will become more apparent upon consideration of the following detailed description and the appended claims with reference to the accompanying drawings, all of which form a part of this specification wherein like reference numerals designate corresponding parts in the various figures.

DETAILED DESCRIPTION OF THE PRESENTLY PREFERRED EXEMPLARY EMBODIMENT

Figure 1:
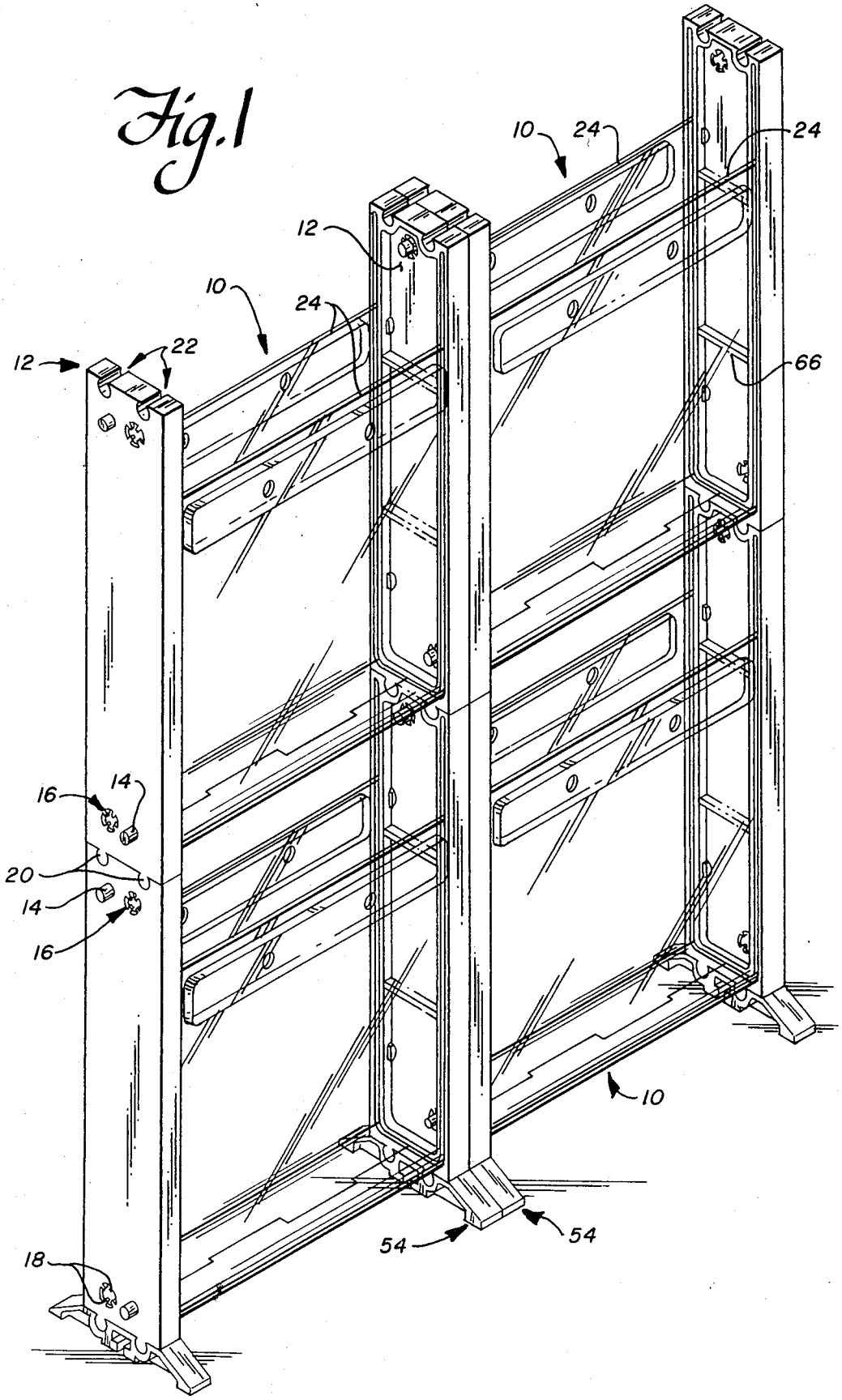
FIG. 1 is a perspective view of a display assembly formed in accordance with the present invention.

A snap-fit display assembly is shown by way of example in FIG. 1. The illustrated assembly includes four display modules 10 which have been snap-fit together to form an integral display. More particularly, each display module 10 formed in accordance with the present invention includes first and second side walls 12 which have releasable coupling structures so that modules can be connected together, side-by-side. Thus, referring in particular to FIGS. 2 and 3, in the preferred embodiment the coupling structures for side-by-side connection are cooperating pins 14 and holes 16 provided near the upper end and near the lower end of each of the side walls 12. Because each side wall 12 of each display module 10 is identical, as described more fully below, and because each includes pins 14 and holes 16 disposed for cooperating engagement when two side walls 12 are placed in facing relation, one display 10 can be quickly and easily snap-fit to the next adjacent module 10. As can be seen, in the preferred embodiment, each hole 16 includes a number of inwardly directed projections 18, thereby facilitating insertion of a corresponding pin 14, yet resisting easy withdrawal of the same.

Figure 2:
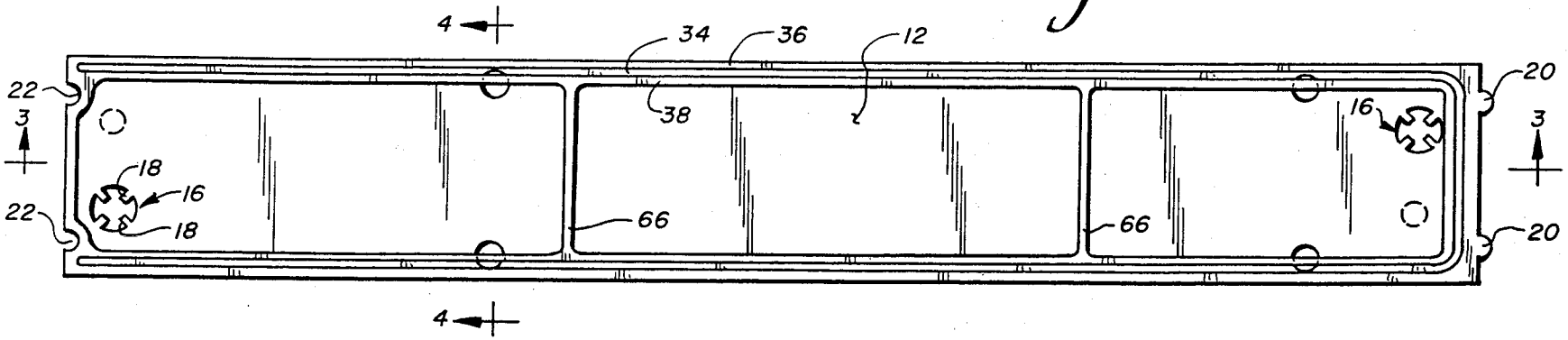
FIG. 2 is a plan view of the inner surface of a side wall of a display module formed in accordance with the invention.
Figure 3:
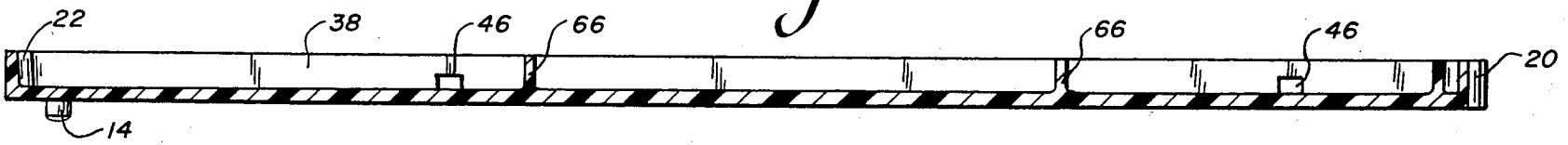
FIG. 3 is a cross-sectional view taken along line 3—3 of FIG. 2.
Figure 4:
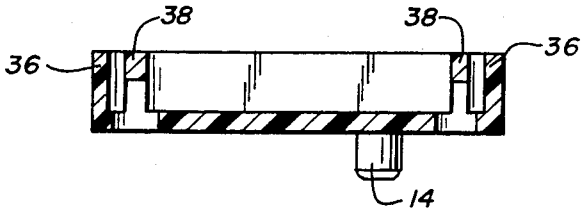
FIG. 4 is a cross-sectional view taken along line 4—4 of FIG. 2.

Referring to FIGS. 1 and 2, each of the side walls 12 of each display module 10 further includes a coupling structure at each longitudinal end thereof for connecting the side wall to a side wall of a vertically adjacent upper or lower display module. In the illustrated embodiment, the connectors are slide connectors in the form of elongated beads 20 and correspondingly shaped grooves 22. In this manner, vertically adjacent display modules 10 can be quickly and easily slid together so as to form a unitary vertical structure. Before or after such slide engagement, other display modules can be snap-fit horizontally to form a display assembly having a desired number and configuration of vertical and horizontal display modules.

As is apparent, vertical stress on the display modules 10 as a result of the weight of magazines or brochures placed therein will be carried by the interlocking pin 14 and hole 16 arrangement and thus by the adjacent modules 10. Likewise, downward loads tending to urge a display module 10 away from a vertically adjacent display module 10 will be resisted by the interlocking bead 20 and groove 22 configuration of the vertical connectors. Accordingly, once the display assembly has been snap-fit and slid together, stresses on the display as a whole which would otherwise tend to disconnect or deform the assembly are resisted, and the display will remain in its assembled state until disassembly is desired.

Figure 5:
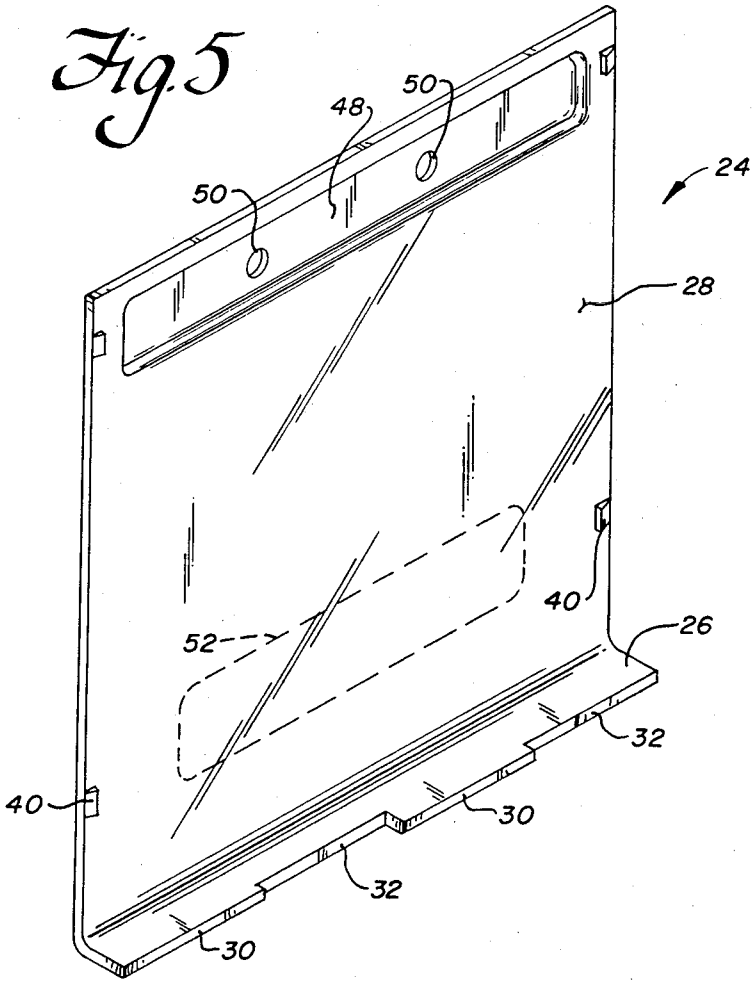
FIG. 5 is a perspective view of a front or rear panel element of the display module formed in accordance with the present invention.

Referring to FIG. 5, while the front, rear and bottom of each display module could be a separate panel, in accordance with the preferred embodiment of the present invention, the front panel 24 of each display module is identical to the rear panel 24 and each is substantially "L"-shaped in cross-section. Thus, the "short arm" 26 of each L-shaped panel defines half of the bottom wall of module 10 and the "long arm" 28 of each panel defines the front and rear faces of module 10. Furthermore, in the preferred embodiment, the innermost edge of the "short arm" 26 of front and rear panels 24 includes one or more projecting portions 30 and one or more recessed portions 32 so as to define a staggered, innerlocking seam when the panels are coupled together. Thus, the pages of magazines or brochures placed within the module will not slide through the joint of the front and rear panels. In the illustrated embodiment, two projections 30 and two correspondingly shaped recesses 32 are provided.

Figure 6:
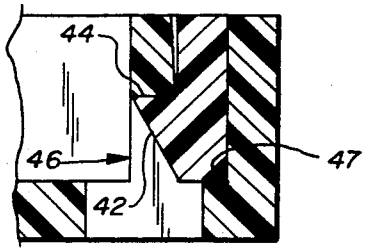
FIG. 6 is an enlarged view, partly broken away for clarity showing the snap-fit relation of a front or rear panel to a side wall element of the present invention.

Referring to FIGS. 2, 5, and 6, it can be seen that the vertical side edges of the front and rear panels are sized so as to slidably engage a peripheral groove 34 defined by outer and inner spaced apart peripheral projecting flanges 36, 38 on the inner surface of each side wall 12. By slidably engaging front and rear panels 24 with first and second side walls 12, a three dimensional display module can be formed.

Preferrably, the front and rear panels 24 each include at least one snap-fit element 40 for interlocking the same with the side walls 12. In the illustrated embodiment, two snap-fit elements 40 are provided on the inner surface of each panel 24 adjacent the vertical side edges thereof. As can be seen in FIG. 6, each snap-fit element 40 has an inclined surface 42 and a flat face 44 for coupling in a snap-fit manner to corresponding recesses 46 defined in the side walls. In the illustrated embodiment, the recesses 46 are formed in inner flange 38 of side wall 12 during molding with, for example, a pin (not shown) which extends upwardly from the lowermost surface of the mold (not shown) to form an opening 46 in the inner flange. Thus, when the front or rear panel 24 of module 10 is inserted into side wall groove 34, the engagement of inner flange 38 with inclined surface 42 of snap-fit element 40 will deflect panel 24 slightly outwardly until flat wall 44 of snap-fit element 40 is adjacent the recess or cutout portion 46 of side wall 12 and the side edge of panel 24 abuts stop shoulder 47. Then, panel 24 will resiliently flex to its unstressed position with snap-fit element 40 within recess 46. This snap-fit engagement, however, is such that with a reasonable amount of force and/or slight manual deformation of panels 24, side wall 12 and front and rear panels 24 can be disengaged.

The upper portion of the front and rear panels preferably each further include a transverse offset portion 48. This portion is offset a distance corresponding to the thickness of outer flange 36 of side wall 12 and has one or more holes 50 defined therein. Thus, a wall mounting element (not shown) such as a nail, screw or hook can be inserted into a hole 50 and display module 10 or an assembly of display modules can be mounted flush to the wall without the mounting element interfering with or damaging objects placed within the same. Finally, front and rear panels 24 can include a hole 52 as illustrated in phantom lines to facilitate viewing and access to materials therein.

Figure 7:
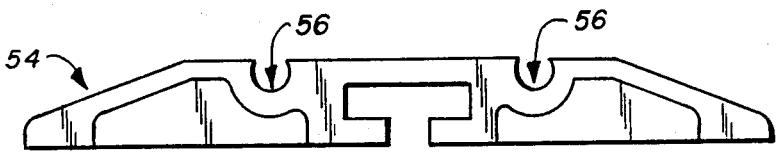
FIG. 7 is an elevational view of a base stand for a display module of the present invention.
Figure 8:
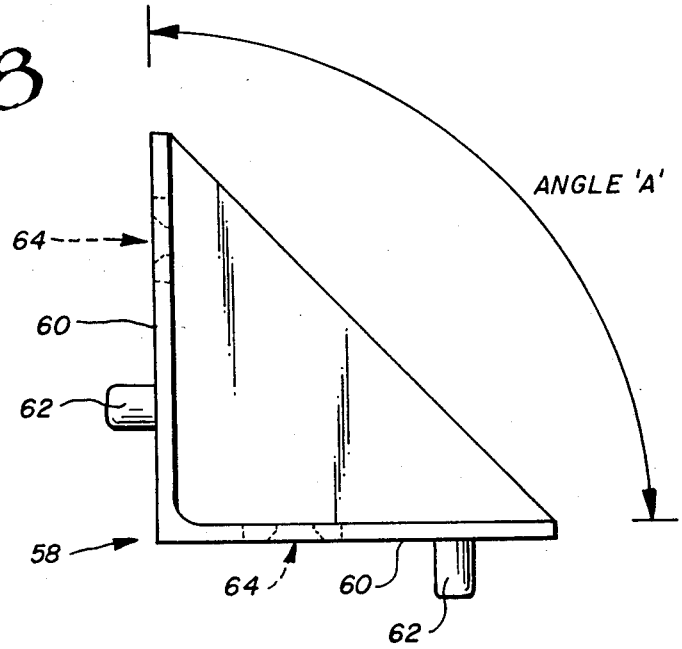
FIG. 8 is a top plan view of an angular bracket of the invention.

Referring now to FIG. 7, first and second base elements 54 for the display module can be provided which include grooves 56 sized to slidingly engage the beaded portions 20 defined on the lowermost edge of side walls 12. In this manner, individual display modules or an assembled set of display modules can be mounted on the floor or on a table (not shown) or the like rather than to a wall. A separate floor stand display (not shown) may be provided, however, to accommodate the display assembly. As illustrated in FIG. 8, two or more side brackets 58 can be provided to interconnect adjacent modules. Bracket 58 has first and second arms 60 which are connected at first ends thereof and define an angle A for mounting modules in angular relation to one another and, thus, further enhance the versatility of the display modules themselves. As can be seen, each arm 60 includes pins 62 and holes 64 which correspond in size and shape to those provided on the side walls themselves for easy attachment thereto, between horizontally adjacent modules.

While in the preferred embodiment the parts of the display module are formed from a clear plastic material so that the contents thereof can be seen, it is to be understood that the module could be formed from any desired material without departing from the present invention. Further, one or more vertical or horizontal ribs can be provided along the length or width of the side wall on the interior surface thereof to support magazines or brochures mounted therein. Horizontal ribs 66 are shown, for example, in FIGS. 2 and 3. In addition, while in the illustrated embodiment pins and holes and beads and grooves are shown, respectively, for the side and vertical attachment structures, it is to be understood that other cooperating coupling structures or shaped elements could be used without departing from this invention. Finally, as is readily apparent to one of ordinary skill, the modules of the invention can be formed with various heights and widths and any number of modules having identical heights irrespective of width can be coupled horizontally. Likewise, modules of identical width can be vertically coupled irrespective of height to form an assembly.

While the invention has been described in connection with what is presently considered to be the most practical and preferred embodiment, it is to be understood that the invention is not limited to the disclosed embodiment, but, on the contrary, it is intended to cover various modifications and equivalent arrangements included within the spirit and scope of the appended claims.

What is claimed is:

1. A display module comprising:

a front panel having a substantially planar front face portion;

a rear panel having substantially planar rear face portion;

means defining a base wall interconnecting the front face portion of said front panel and the rear face portion of said rear panel; and first and second side wall elements, each releasably coupled to said front panel and said rear panel so as to define an interior space for receiving objects to be displayed;

each said side wall element further including means for releasably coupling a horizontally next adjacent display module and means for releasably coupling to a vertically next adjacent display module.

2. A display module as in claim 1, wherein said means for releasably coupling to a vertically next adjacent display module include at least one enlarged bead element defined at one of the first and second longitudinal ends of said side wall element and at least one groove defined at the opposite longitudinal end of said side wall element for slidably engaging a groove and bead, respectively, defined at the respective longitudinal end of a vertically next adjacent display module side wall element.

3. A display module as in claim 2, wherein the uppermost vertical end of each said side wall includes first and second spaced apart bead elements and the lowermost end of each said side wall includes first and second grooves spaced apart a distance corresponding to the spacing of said bead elements whereby vertically adjacent display modules can be slid fit together so that beads and grooves of vertically adjacent display modules are disposed in interlocking relation.

4. A display module as in claim 1, wherein said means for removably coupling to a horizontally next adjacent display module include at least one pin element and at least one hole defined in each said side wall element for slidably engaging a corresponding hole and pin, respectively, provided on the side wall element of a horizontally next adjacent display module.

5. A display module as in claim 4, wherein each said side wall element includes a pin and a hole defined at an upper portion and a pin and a hole defined at the lower portion thereof for interlocking engagement with correspondingly spaced apart holes and pins of a next adjacent display module side wall element.

6. A display module as in claim 1, in combination with first and second stand elements including means for interconnecting with said means for releasably coupling to a vertically next adjacent display module whereby a display module can be mounted in standing relation to a flat surface.

7. A display module as in claim 1, wherein at least one of said front and rear panels includes means for mounting the display module to a wall.

8. A display module as in claim 1, wherein each said side wall element includes outer and inner spaced apart peripheral projecting flange elements which define therebetween a groove which extends around at least a portion of the periphery of said side wall, said groove being sized so as to receive a vertical side edge said front panel and a vertical side edge of said rear panel so as to enable the releasable coupling of said side walls to said front and rear panels.

9. A display module as in claim 8, wherein each said front and rear panels has at least one snap-fit element defined on at least one of the inner and outer surface thereof, adjacent each vertical side edge thereof for cooperating in snap-fitting relation with a corresponding recess defined along at least one of said inner and outer flanges whereby said front and rear panels are each releasably coupled by a snap-fit to each said side wall.

10. A display module as in claim 9, wherein each said snap-fit element includes an inclined face and a flat face for, respectively, deflecting and locking said panel on which it is provided relative to the flange including said corresponding recess.

11. A display module as in claim 9, wherein each said front and rear panels includes two snap-fit elements on the innersurface thereof along each vertical side edge thereof for cooperating with corresponding recesses defined along the length of each said inner flange.

12. A display assembly comprising at least two display modules horizontally coupled together, each said display module including:

a front panel;

a rear panel;

means defining a base wall interconnecting a front face portion of said front panel and a rear face portion of said rear panel; and first and second side wall elements, each releasably coupled to said front panel and said rear panel so as to define an interior space for receiving objects to be displayed;

each said side wall element further including means for releasably coupling a horizontally next adjacent display module.

13. A display assembly as in claim 12, wherein at least one of said horizontally coupled display modules further includes means for releasably coupling to a vertically next adjacent display module and wherein the assembly further comprising at least one display module vertically coupled to said at least one horizontally coupled display modules and including:

a front panel having a substantially planar front face portion;

a rear panel having a substantially planar rear face portion;

means defining a base wall interconnecting the front face portion of said front panel and the rear face portion of said rear panel; and first and second side wall elements, each releasably coupled to said front panel and said rear panel so as to define an interior space for receiving objects to be displayed;

each said side wall element further including means for releasably coupling to a vertically next adjacent display module.

14. A display assembly as in claim 12, further comprising at least one bracket element having first and second arms mounted together at first ends thereof so as to define an angle A between the longitudinal axes thereof, each said arm including means for removably coupling to said means for removably coupling to a horizontally next adjacent module whereby at least first and second display modules of said assembly are horizontally coupled together at an angle.

15. A display assembly as in claim 13, further comprising at least one bracket element having first and second arms mounted together at first ends thereof so as to define an angle A between the longitudinal axes thereof, each said arm including means for removably coupling to said means for removably coupling to a horizontally next adjacent module whereby at least first and second display modules of said assembly are horizontally coupled together at an angle.

16. A display assembly comprising at least two display modules vertically coupled together, each said display module including:

a front panel having a substantially planar front face portion;

a rear panel having a substantially planar rear face portion;

means defining a base wall interconnecting the front face portion of said front panel and the rear face portion of said rear panel; and first and second side wall elements, each releasably coupled to said front panel and said rear panel so as to define an interior space for receiving objects to be displayed;

each said side wall element further including means for releasably coupling to a vertically next adjacent display module.

17. A display module comprising: a front panel; a rear panel; means defining a base wall interconnecting a front face portion of said front panel and a rear face portion of said rear panel; and first and second side wall elements, each releasably coupled to said front panel and said rear panel so as to define an interior space for receiving objects to be displayed; each said wall element further including means for releasably coupling a horizontally next adjacent display module and means for releasably coupling to a vertically next adjacent display module and wherein said front panel and said rear panel are identical and are L-shaped in cross-section, the bases of said L-shaped panels defining said wall means.

18. A display module as in claim 17, wherein each said base of said front and rear panels includes projecting portions and indented portions whereby the bases of the front and rear panels meet at a staggered joint thereby minimizing the likelihood that objects will fall therebetween.

* * * * *